US008104670B2

(12) United States Patent
Mitchell

(10) Patent No.: US 8,104,670 B2
(45) Date of Patent: Jan. 31, 2012

(54) COMBINED GREETING CARD GIFT/MAIL ORDER CONTAINER

(75) Inventor: Gareth Mitchell, Greater Manchester (GB)

(73) Assignee: Tree 2 My Door Limited, Manchester, Greater Manchester (GB)

( * ) Notice: Subject to any disclaimer, the term of this patent is extended or adjusted under 35 U.S.C. 154(b) by 169 days.

(21) Appl. No.: 12/517,355

(22) PCT Filed: Dec. 5, 2007

(86) PCT No.: PCT/GB2007/004639

§ 371 (c)(1), (2), (4) Date: Jun. 2, 2009

(87) PCT Pub. No.: WO2008/068474

PCT Pub. Date: Jun. 12, 2008

(65) Prior Publication Data

US 2010/0078340 A1 Apr. 1, 2010

(30) Foreign Application Priority Data

Dec. 6, 2006 (GB) ..... 0624345.5

(51) Int. Cl.
*B65D 5/00* (2006.01)

(52) U.S. Cl. ..... 229/115; 206/232; 206/766; 229/126

(58) Field of Classification Search ..... 206/232, 206/831, 423, 575, 766, 772, 773, 767; 40/312, 40/313; 229/115, 116, 221, 126
See application file for complete search history.

(56) References Cited

U.S. PATENT DOCUMENTS

| | | | | |
|---|---|---|---|---|
| 2,935,192 | A * | 5/1960 | De Million-Czarnecki Gabryel | 206/396 |
| 3,144,932 | A * | 8/1964 | Zerbo | 206/575 |
| 3,550,834 | A * | 12/1970 | McCall | 229/115 |
| 5,038,930 | A * | 8/1991 | Holtkamp, Jr. | 206/232 |
| 5,143,279 | A | 9/1992 | Gaines | |
| 5,226,532 | A * | 7/1993 | Davidson et al. | 206/232 |
| 6,202,838 | B1 * | 3/2001 | Tran | 206/232 |
| 6,779,658 | B2 * | 8/2004 | Polloni et al. | 206/268 |
| 6,868,964 | B2 * | 3/2005 | Carty et al. | 206/232 |
| 2004/0084513 | A1 * | 5/2004 | Testerman et al. | 229/115 |
| 2005/0217153 | A1 | 10/2005 | Ward, II | |

FOREIGN PATENT DOCUMENTS

| | | | |
|---|---|---|---|
| GB | 755507 | A | 8/1956 |
| GB | 2190659 | A | 11/1987 |
| GB | 2296706 | A | 7/1996 |
| WO | WO 96/22230 | A1 | 7/1996 |

* cited by examiner

*Primary Examiner* — David Fidei
(74) *Attorney, Agent, or Firm* — Edwin D. Schindler

(57) ABSTRACT

A combination greeting card and gift container includes a gift container portion having a plurality of panels, in which at least one panel forms an oblique surface with respect to the remainder of the panels. The gift container preferably includes an integral device for securing a greeting card positioned on a first panel of the gift container. There may also be included an integral greeting card cover formed from a second panel of the gift container.

9 Claims, 2 Drawing Sheets

COMBINED GREETING CARD GIFT/MAIL ORDER CONTAINER

The present invention relates to improvements to personalised gift product packaging and more particularly a novel packaging article and to methods of packaging and/or greetings card display.

Generally, the invention described herein is a one piece container in which unique greetings cards and leaflets can be mounted to the wall of the container without the use of additional materials. The container is designed with a tapered panel which encourages the container to be opened in a particular way.

More particularly, the invention is concerned with the provision of a container in which unique greetings cards and leaflets can be mounted to the wall of the container to be exposed when the container is opened.

Mail order and gift containers of various kinds are well known in the art. Several problems are known with the combination of greetings cards with containers, briefly outlined below:

mail order containers that include a greeting card in addition to a unique gift product do not accommodate for the positioning and safe transit of a greeting card within the unit;

combination greeting card containers in the market include greetings cards that are affixed to the outside of the unit, so the greeting card is exposed, reducing enjoyment, surprise and anticipation;

combination greeting card containers in the market include greetings cards that are affixed to the inside wall of the unit, so the greeting card is not exposed until the container is opened; and combination greeting card containers in the market include greetings cards that are affixed to the inside wall of the unit, however, containers can often be opened in a number of ways, reducing the impact and exposure of the greeting card inside the container.

Various attempts have been made to improve card and gift box combinations. Thus, for example, U.S. Pat. No. 6,070,719 describes a greeting card and gift box combination made from a single sheet of cardboard having a gift box member with a window for viewing a gift mounted therein. Whilst the combination package does adequately protect the greetings card it generally does not retain the element of surprise for the recipient. The invention described therein does offer the option of including a slidably mounted envelope cover, however, this is not integral to the gift box and is therefore expensive to manufacture and time consuming to assemble.

Similarly, U.S. Pat. No. 5,497,876 describes a card and gift box combination prepared from a one-piece blank wherein the box has a double cover. When the top section of the cover is lifted, a greeting card is exposed. However, the box is not provided with an integral card holder, rather the box is simply provided with a surface to which the card may be adhered.

It is desirable to provide a greeting card and container combination that will facilitate the element of surprise and enjoyment by hiding the view of the greeting card in a section located under the container lid. It is also desirable to encourage the container to be opened in a particular way as to first reveal the attached greeting card and leaflets.

It is a primary objective of the present invention to provide a combination greeting card/gift container that can be opened easily through one side only.

Another important objective of the present invention is to provide a combination greeting card/gift container is that it can be personalised by the gift sender.

Still another important objective of the present invention is to provide a combination greeting card/gift container that is manufactured in one piece of material.

Yet another important objective of the present invention is to provide a combination greeting card/gift container with a hidden panel that can hold a greeting card and leaflets that are revealed once the box is opened.

Still another important objective of the present invention is to provide a combination greeting card/gift container that is assembled with additional materials by or on behalf of the gift giver and then combined to form one single integrated package.

Yet another important objective of the present invention is to provide a combination greeting card/gift container with a tapered top to encourage opening on one side.

And another important objective of the present invention is to provide a combination greeting card/gift container with a gift holding chamber once assembled.

These and other objects of the present invention are achieved by providing a foldable cardboard blank, including foldable panels, die cut sections, wall flaps, self locking tabs and finger pull tabs. The cardboard blank can be folded into a gift box configuration with a side hinged cover panel that is locked in place with finger tab and end hinged cover flaps. A hinged under cover panel has die cut sections that allow greetings cards and leaflets to be securely slid into the panel wall. Once the under panel is folded down, the gift contents of the box are revealed behind the panel.

The invention will now be described by way of example only and with reference to the accompanying drawings in which FIG. 1 is an external/plan view of the disassembled container prior to folding and assembly;

Figure 1:
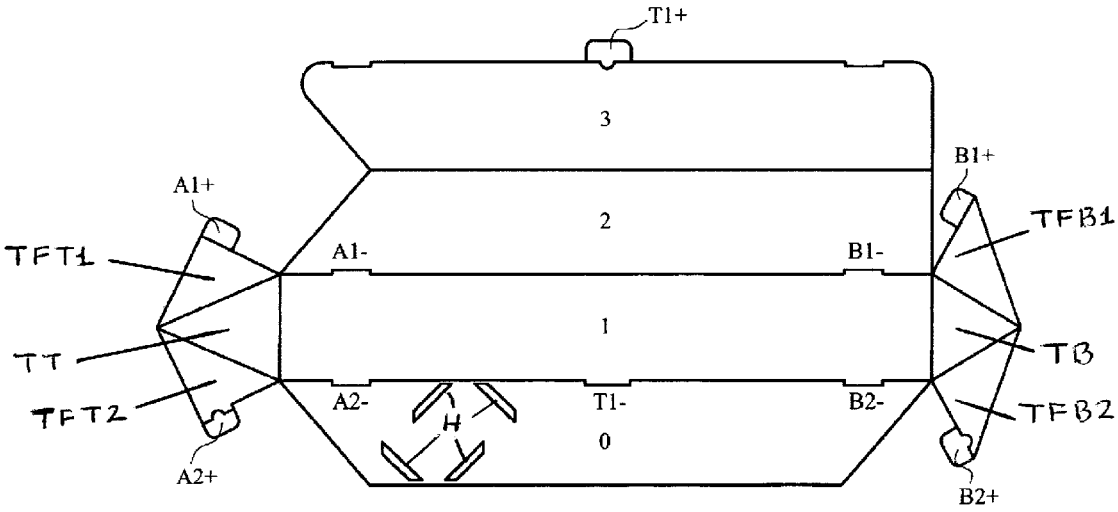

Referring to FIG. 1, the drawing shows the flat net of the container with fold lines. All folds represented on FIG. 1 fold away from view. Working up from panel 1, each of the remaining three panels is folded to create a triangular shaped container. The features shown in FIG. 1 include a triangular base TB; a triangular top TT; a triangular flap of the base TFB1 having a base locking tab B1+; a triangular flap of the top TFT1 having a top locking tab A1+; a triangular flap of the base TFB2 having base finger flap B2+; and a triangular flap of the top TFT2 having top finger flap A2+. The top locking tab Al+ is folded and inserted into a tab slot A1− and then the base locking tab B1+ is folded and inserted into a tab slot B1−. A rigid chamber is now created into which a gift product can be inserted. Insert a gift product such as flowers, trees or other gifts into the chamber and fold the under panel towards the chamber, fold the product securing flap into the chamber to secure the gift product if necessary. Fold panel 3 over the under panel and fold finger tab T1+ into tab slot T1−. Finally fold finger flap A2+ into tab slot A2− and finger flap B2+ into tab slot B2−.

Figure 2:
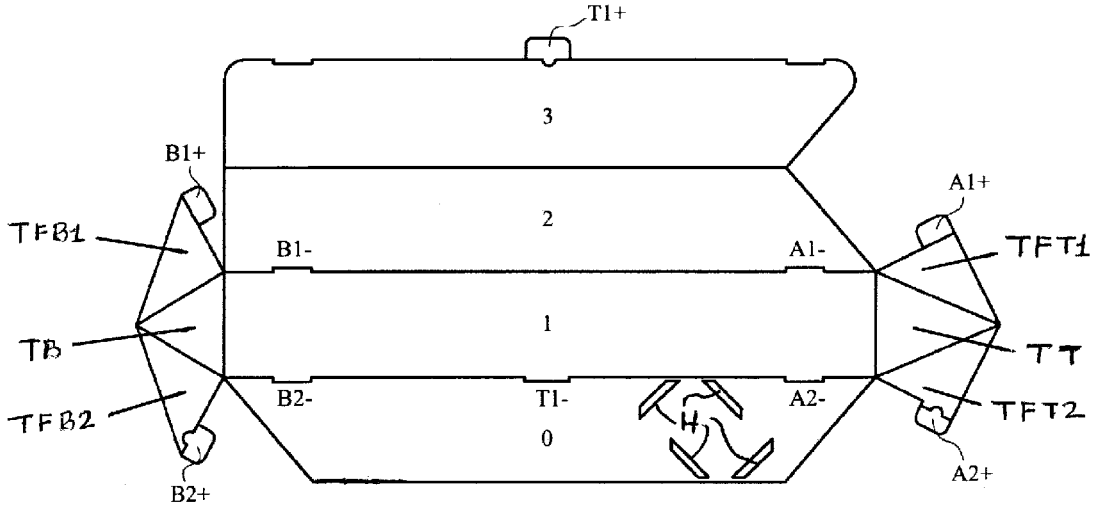
FIG. 2 is an internal/underside view of the disassembled container prior to folding and assembly.

FIG. 2 shows the underside view of the container.

Figure 3:
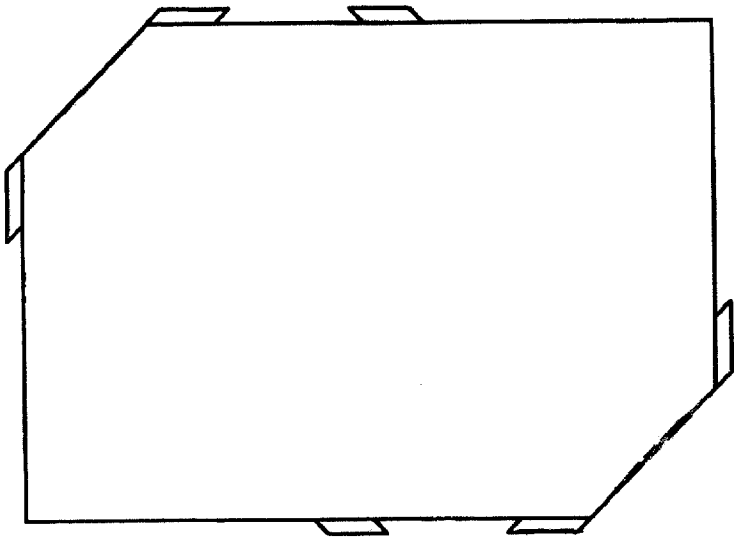
FIG. 3 is a schematic representation of a greeting card sample that is held in place in the container.

FIG. 3 illustrates how a greeting card can be mounted into the container wall without the use of adhesives by sliding and gently inserting the greeting card into the cut holes.

Figure 4:
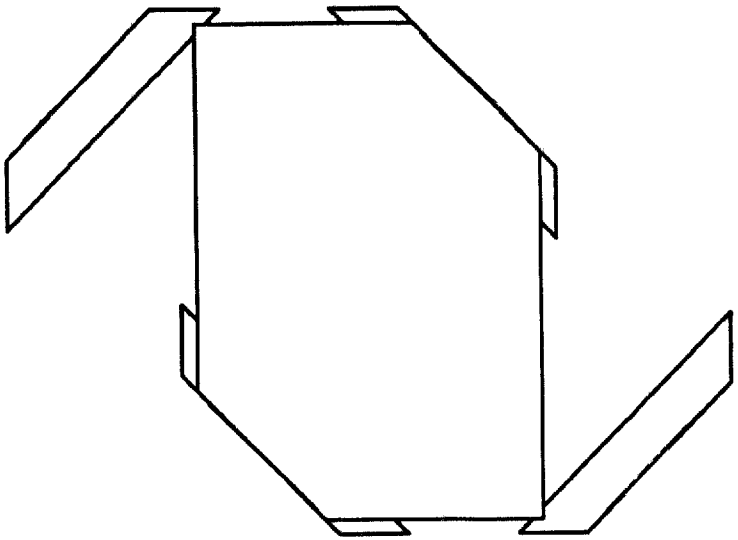
FIG. 4 is a schematic representation of a leaflet sample that is held in place in the container.

FIG. 4 illustrates how a leaflet can be mounted into the container wall without the use of adhesives by sliding and gently inserting a leaflet into the cut holes (H).

The tapered top panel of the container boasts a longer height and increased angle than the height of the base panel. This design feature reduces the physical space at the top of the gift chamber. This also restricts the amount of outside surface area on panel 3 and panel 2 of the assembled container. The restricted surface area on panel 3 and panel 2 encourages the box to sit naturally on panel 1 the base panel.

The invention claimed is:

1. A foldable blank, comprising:

a first side panel having a horizontal middle closure tab thereon with two open tab slots at each side of a horizontal edge;

a second side panel foldably connected to said first side panel along a lower horizontal fold line;

a rectangular base panel foldably connected to said second side panel incorporating two closed tab slots at each side of the lower horizontal fold line;

a triangular top panel foldably connected at a base of a triangle to said rectangular base panel;

a triangular flap foldably connected to a side of said triangular top panel and including a locking tab from a corner base;

a triangular flap foldably connected to an underside of said triangular top panel and including a locking tab from the corner base;

a triangular base panel foldably connected at the base of the triangle to said rectangular base panel;

a triangular flap foldably connected to a side of said rectangular base panel and including a locking tab from the corner base;

a triangular flap foldably connected to an underside of said rectangular base panel and including a locking tab from the corner base; and, an under panel foldably connected to said rectangular base panel, including three closed tab slots along the horizontal fold line, including two sets of mirrored diagonal holes for mounting greeting cards and leaflets, and including a cut folded flap.

2. A gift container, comprising:

a plurality of panels with at least one panel of said plurality of panels forming an oblique surface relative to a remainder of panels of said plurality of panels with an arrangement of said plurality of panels being formed from a foldable blank with said foldable blank including:

a first side panel having a horizontal middle closure tab thereon with two open tab slots at each side of a horizontal edge;

a second side panel foldably connected to said first side panel along a lower horizontal fold line;

a rectangular base panel foldably connected to said second side panel incorporating two closed tab slots at each side of the lower horizontal fold line;

a triangular top panel foldably connected at a base of a triangle to said rectangular base panel;

a triangular flap foldably connected to a side of said triangular top panel and including a locking tab from a corner base;

a triangular flap foldably connected to an underside of said triangular top panel and including a locking tab from the corner base;

a triangular base panel foldably connected at the base of the triangle to said rectangular base panel;

a triangular flap foldably connected to a side of said rectangular base panel and including a locking tab from the corner base;

a triangular flap foldably connected to an underside of said rectangular base panel and including a locking tab from the corner base; and, an under panel foldably connected to said rectangular base panel, including three closed tab slots along the horizontal fold line, including two sets of mirrored diagonal holes for mounting greeting cards and leaflets, and including a cut folded flap.

3. The gift container according to claim 2, further comprising an integral greeting card cover formed from a panel of said plurality of panels.

4. The gift container according to claim 2, wherein said arrangement of said plurality of panels is shaped as a prism.

5. The gift container according to claim 4, wherein said at least one panels of said plurality of panels forming said oblique surface is an end panel of said prism.

6. A combination greeting card and gift container, comprising:

a gift container portion having a plurality of panels with at least one panel of said plurality of panels forming an oblique surface relative to a remainder of panels of said plurality of panels with an arrangement of said plurality of panels being formed from a foldable blank with said foldable blank including:

a first side panel having a horizontal middle closure tab thereon with two open tab slots at each side of a horizontal edge;

a second side panel foldably connected to said first side panel along a lower horizontal fold line;

a rectangular base panel foldably connected to said second side panel incorporating two closed tab slots at each side of the lower horizontal fold line;

a triangular top panel foldably connected at a base of a triangle to said rectangular base panel;

a triangular flap foldably connected to a side of said triangular top panel and including a locking tab from a corner base;

a triangular flap foldably connected to an underside of said triangular top panel and including a locking tab from the corner base;

a triangular base panel foldably connected at the base of the triangle to said rectangular base panel;

a triangular flap foldably connected to a side of said rectangular base panel and including a locking tab from the corner base;

a triangular flap foldably connected to an underside of said rectangular base panel and including a locking tab from the corner base; and, an under panel foldably connected to said rectangular base panel, including three closed tab slots along the horizontal fold line, including two sets of mirrored diagonal holes for mounting greeting cards and leaflets, and including a cut folded flap, and, a greeting card secured and positioned on, or formed from, a panel of said plurality of panels of said gift container portion.

7. The combination greeting card and gift container according to claim 6, wherein said arrangement of said plurality of panels is shaped as a prism.

8. The combination greeting card and gift container according to claim 7, wherein said at least one panels of said plurality of panels forming said oblique surface is an end panel of said prism.

9. The combination of greeting card and gift container according to claim 6, wherein said greeting card is secured and positioned on said panel of said plurality of panels of said gift container portion via a plurality of slots.

* * * * *